United States Patent [19]

Artz et al.

[11] Patent Number: 4,573,521

[45] Date of Patent: Mar. 4, 1986

[54] TESTING APPARATUS FOR DETECTING DAMAGE OF THE CASTING BELTS OF A CONTINUOUS CASTING MOLD

[75] Inventors: Gerd Artz, Ratingen; Dieter Figge, Essen, both of Fed. Rep. of Germany

[73] Assignee: Haftung Fried. Krupp Gesellschaft mit beschränkter, Essen, Fed. Rep. of Germany

[21] Appl. No.: 674,402

[22] Filed: Nov. 23, 1984

[30] Foreign Application Priority Data

Nov. 26, 1983 [DE] Fed. Rep. of Germany ..... 3342941

[51] Int. Cl.[4] ..... B22D 11/06

[52] U.S. Cl. ..... 164/451; 164/150

[58] Field of Search ..... 164/451, 452, 453, 150, 164/154, 155

[56] References Cited

U.S. PATENT DOCUMENTS

| | | | |
|---|---|---|---|
| 3,123,874 | 3/1964 | Hazelett et al. | 164/154 |
| 3,512,401 | 5/1970 | Thalmann | 164/154 X |

FOREIGN PATENT DOCUMENTS

| | | | |
|---|---|---|---|
| 57-171552 | 10/1982 | Japan | 164/150 |
| 1648421 | 7/1970 | Fed. Rep. of Germany . | |
| 2501868 | 12/1977 | Fed. Rep. of Germany . | |
| 2923398 | 10/1980 | Fed. Rep. of Germany . | |

*Primary Examiner*—Nicholas P. Godici
*Assistant Examiner*—J. Reed Batten, Jr.
*Attorney, Agent, or Firm*—Spencer & Frank

[57] ABSTRACT

For the purpose of monitoring the casting belts during operation of the caster to detect damage or faults to the casting belts, a plurality of ultrasonic testing units, which are stationary with respect to the direction of rotation of the casting belts and which are each designed as to transmit/receive unit, are associated with each casting belt.

18 Claims, 6 Drawing Figures

TESTING APPARATUS FOR DETECTING DAMAGE OF THE CASTING BELTS OF A CONTINUOUS CASTING MOLD

BACKGROUND OF THE INVENTION

The present invention relates to a testing apparatus and method for detecting damage to the casting belts on a continuous casting mold or caster where these belts form corotating mold walls.

Continuous casting molds or casters with co-rotating mold walls, comprised, in particular, of a pair of oppositely disposed endless casting belts and a pair of oppositely disposed laterally following endless lateral dam blocks, are used to attain high casting rates (in the order of magnitude of 10 m/minute) in the casting of lead, zinc, copper and steel.

The so-called twin belt continuous casting molds or casters are equipped at their top and at their bottom with a casting belt made of carbon steel and having a thickness of about 1 mm. Since the thin casting belts are subject to considerable thermal and mechanical stresses, which may lead to crack formation in particular, they are exchanged normally after about 24 to 32 hours of operation in spite of the relatively low operating temperatures encountered when casting lead, zinc and copper. This exchange is done merely as a precautionary measure because the precise moment when the belts become useless has so far not been determinable. Moreover, when casting metals, it is desirable to detect damage to the casting belts early, particularly because the danger of an explosion when the metal melt impinges on the cooling water provided in the region of the continuous casting mold and its consequences also exists for the devices surrounding the mold.

SUMMARY OF THE INVENTION

It is the object of the present invention to provide a testing apparatus and method for the early detection of damage to the particularly endangered casting belts of continuous casting molds, with such apparatus being used, in particular, in connection with the casting of steel but also in systems processing nonferrous metals.

The testing device or arrangement should be configured in such a manner that during casting, the casting belts can be monitored continuously for the appearance of cracks and other faults without interfering with their operational capabilities.

The above object is generally achieved according to the present invention in that in a continuous metal caster of the type having co-rotating mold walls formed by a pair of vertically opposed endless casting belts and a pair of endless lateral dam blocks, testing means are disposed adjacent the casting belts during operation of the caster for detecting damage to the casting belts, with this testing means including a plurality of ultrasonic testing units, each having an ultrasonic transmitter-receiver, disposed adjacent each of the casting belts so that each ultrasonic transmitter-receiver is sonically coupled to the surface of the adjacent casting belt, and means for mounting each testing unit so that it is stationary with respect to the direction of movement of the adjacent casting belt.

Accordingly, the idea on which the present invention is based is that each casting belt has associated with it a plurality of testing units in the form of transmit/receive units which are held stationary with respect to the direction of movement of the associated belt and operate according to the ultrasonic method. Preferably, these generally known testing units are arranged and designed in such a manner that their testing heads are disposed opposite and slightly spaced away from the associated casting belt, with the space between the unit and the belt being bridged by a film of water which serves as the coupling medium between the casting belt and the testing or sensor heads. The distance between the belt and the testing device, and thus the thickness of the film of water, during casting lies in the order of magnitude of a few tenths of a millimeter. Advisably, the cooling water provided in any case for cooling the casting belts serves as the coupling medium.

In order to be able to detect possible damage to the casting belts as quickly as possible, the casting belt should be monitored continuously on its return path. Therefore, preferably the testing units are arranged in that region of the casting belt which performs a return movement opposite to the casting direction.

To obtain correct measuring results, the testing device must be designed in such a manner that the distance between the sensor heads and the associated casting belts does not change during casting or at least changes only to a negligible extent. This can be realized in a simple manner, according to a further feature of the invention, in that the testing units are mounted on movably mounted skids and are supported by way of a film of water on the casting belt, with the water being introduced through spray apertures provided in the region of the test units.

The unchanging position of the sensor heads with respect to the associated casting belt can be assured, according to still a further feature of the invention, in that the testing units are mounted so as to be pivotal about respective horizontal axes, i.e. align themselves by virtue of their own weight. If required, the testing units may be equipped with spring elements which act in the direction toward the casting belts. This latter configuration is applicable particularly if the testing units are disposed opposite the downwardly oriented surface of a casting belt.

Advisably, according to a further feature of the invention, each casting belt is equipped with at least two transverse sounding units and one oblique sounding unit which, when seen in a top view, emit sound waves transversely and at an angle, respectively, to the longitudinal extent of the casting belt.

Two oppositely disposed transverse sounding units, when seen with respect to the center of the casting belt, are used in order to keep the length of the monitoring section, and thus the attenuation of the ultrasonic radiation during passage of the casting belt, as small as possible. In dependence on structural conditions, it is therefore sufficient for each casting belt to have two associated transverse sounding units and one oblique sounding unit, with the latter being arranged in an approximately straight line transverse to the longitudinal extent of the casting belt with the first transverse sounding unit, when seen in the direction of rotation of the casting belt.

The angle at which the oblique sounding units are oriented with respect to the longitudinal extent of the associated casting belt lies in an order of magnitude between 30° and 60°, preferably in an order of magnitude around 45°.

In a particularly efficient testing arrangement according to the invention, each casting belt is equipped with four testing units in the form of two transverse sounding units and two oblique sounding units, with the transverse sounding units, when seen in the direction of rotation of the casting belt, lying behind the two oblique sounding units which are disposed approximately in a straight line transverse to the longitudinal extent or axis of the associated casting belt. The two transverse sounding units emit sound waves directed opposite one another and are therefore arranged one behind the other when seen in the direction of rotation of the casting belt.

The testing device can be complemented by suitable accessories which may permit fully automatic operation, if required. To be able to read out the measuring results in a desired, possibly predetermined sequence from the testing units associated with each casting belt, the testing units may be equipped with a known measuring position switch.

BRIEF DESCRIPTION OF THE DRAWINGS

The present invention will be described in greater detail below with the aid of several embodiments wherein.

DESCRIPTION OF THE PREFERRED EMBODIMENTS

Figure 1:
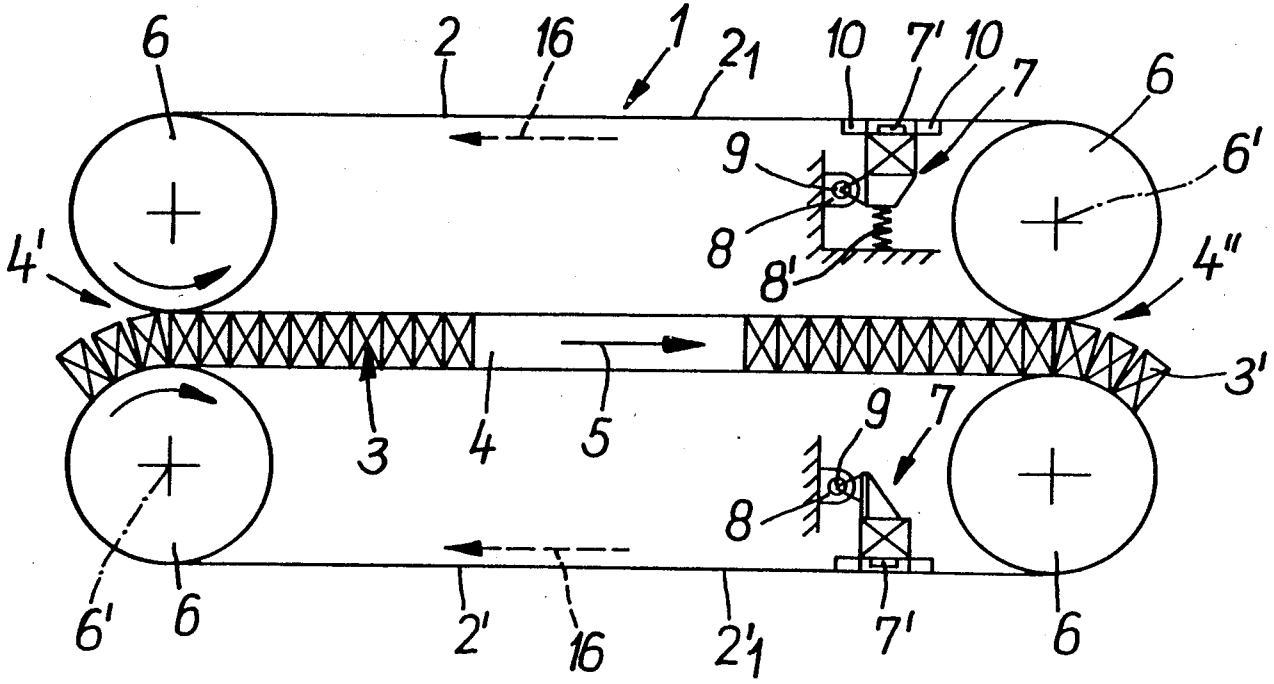
FIG. 1 is a highly schematic vertical sectional view of a continuous casting mold in the region of the rectangular casting cavity formed by the co-rotating mold walls and showing the testing units associated with the upper and lower casting belts.

Referring now to FIG. 1, the schematically shown conventional twin belt continuous casting mold or caster 1 is equipped with co-rotating mold walls in the form of an upper endless casting belt 2 and a lower endless casting belt 2', and two endless lateral dams 3 (only one of which is shown in the figure) following at the sides and composed of individual aligned members 3' which are movable with respect to one another. The casting belts 2, 2', which each have a thickness of about 1 mm, are made of carbon steel, while the individual members 3' are manufactured of a copper alloy.

Mold walls 2, 2' and 3 define a casting cavity 4 having a rectangular cross section, with its entrance 4' and exit 4'' being disposed on the left and right, respectively, of the continuous casting mold and the gradually solidifying steel melt to be processed passing through this cavity in the casting direction, i.e. the direction of arrow 5. The direction of rotation of the mold walls 2, 2' and 3, which are equipped, in the region of entrance 4' and exit 4'' of the mold, with deflection units in the form of pulleys 6 having stationary horizontal axes 6' for the belts 2, 2' and comparable deflection units (not shown) with horizontal axes for the dams 3, has been selected in such a manner that, in the region of casting cavity 4, the mold walls 2, 2', 3 move in the same sense and at the same speed from the left to the right i.e., the casting direction 5.

For continuous monitoring of the casting belts 2 and 2', which are highly stressed thermally as well as mechanically during the casting operation, to detect damage in the form of cracks, holes and the like, a plurality of ultrasonic testing units 7 in the form of transmit/-receive units are provided behind rear deflection rollers 6, when seen in the direction of rotation of the belts, with the sensor heads 7' of these testing units being disposed in the regions $2_1$ and $2_1'$ of the respective casting belts 2 and 2' performing the return movement in the direction opposite to the casting direction, i.e., the direction 16. The testing units 7 are each associated with that surface of casting belt 2 or 2', respectively, which, with respect to casting cavity 4, forms the outer surface of the cavity 4 but which temporarily is no longer in contact with the metal* melt. Thus, the testing units 7 lie within the endless path of the associated casting belts 2 or 2'.

(for example steel)

Figure 2:
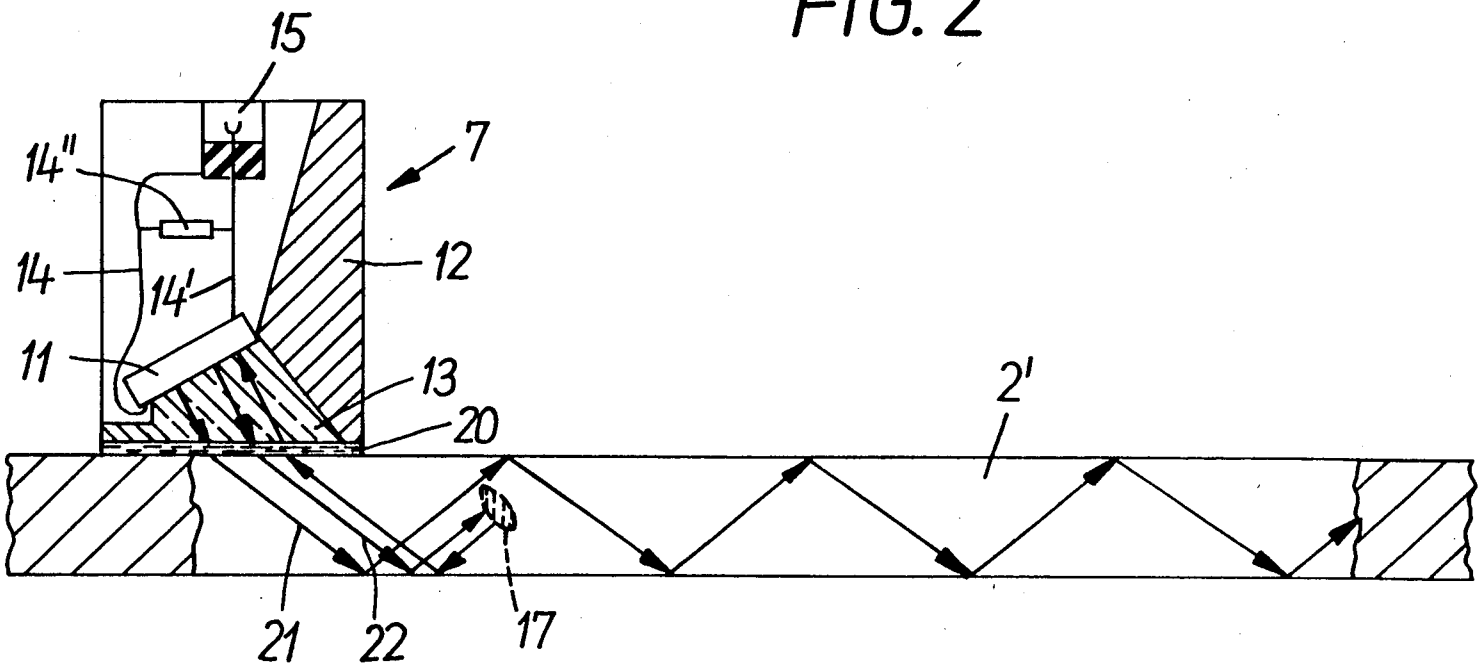
FIG. 2 is a partial vertical sectional view, to a scale different from that of FIG. 1, of the region of the lower casting belt where it performs the return movement and a schematic illustration, partially in section, of a testing unit.

Each testing unit 7 is mounted on a stationary console 8 so as to be pivotal about a horizontal axis of rotation 9 and is equipped with a respective skid 10 which is resiliently supported on the outer surface of the associated casting belt 2 or 2' via a film of water 20 (see FIG. 2). In the case of the upper casting belt 2, the resilient support of the testing unit also includes the influence of a pretensioned vertically oriented spring element 8', while the resilient support in the case of the lower casting belt 2' is under the influence of the weight of the associated testing unit 7. The film of water 20 forms the coupling medium through which the sensor heads 7' are acoustically connected with the associated casting belts 2 or 2'. The associated water is supplied through spray openings (not shown) disposed in the skids 10 of testing units 7 (see FIGS. 4, 5 or 6).

The ultrasonic transmitter-receiver of each testing unit 7 is disposed in the respective sensor head 7'. In operation, an ultrasonic signal is transmitted by a respective sensor head 7' into the associated casting belt 2 or 2' and the return or echo signal attenuated by the respective casting belt 2 or 2' is picked up or received by the same sensor head 7'. If there is damage which changes the attenuating effect, the received return signal will differ noticeably from the return signal produced when the transmitted signal impinges on an undamaged casting belt 2 or 2'. The advantages of the use of testing units operating according to the ultrasonic principle are, in particular, that the operation of the testing unit with respect to compilation and evaluation of measuring results can be automated, that any coating present on the casting belts does not influence the detection of faults, that the signal repetition rate of the testing units 7 permits casting speeds and consequently rpm of the casting belts of more than 100 m/min and that, with the appropriate alignment of the sensor heads 7', damage, particularly cracks, present in different directions can be detected.

The testing units 7 and in particular the sensing units 7' are perse conventional and well known in the art and in principle, as shown in FIG. 2, are comprised of vibratory elements 11 which are enclosed on the sides by a damping housing 12 and are supported on a plexiglass wedge 13. This wedge 13 simultaneously forms the already mentioned skid under which a thin liquid cushion or film 20 is formed during casting to serve as the coupling medium. Through the intermediary of an adapting device 14'', for example, a resistor, electrical connecting lines 14 and 14' end in a connecting plug 15 fastened to the housing 12.

As further shown in FIG. 2, the ultrasonic radiation transmitted by testing unit 7 is coupled into the casting belt 2' at an angle to the surface so that it is reflected at an angle between the surfaces of the casting belt 2'. Some of the transmitted sonic energy, as indicated by the arrows 21 does not impinge on any fault and thus continues to propagate through the casting belt 2' until it reaches a surface which causes it to be reflected back to the testing unit 7. However, as further shown in FIG. 2, another portion of the transmitted energy, indicated by the arrow 22, has been reflected back to the testing unit 7 by a fault 17 in the belt 2'. As is clear, the attenuation of the return signal caused by the fault 17 will be quite different than any return signal produced by the sonic energy Iportion 21, thus indicating the location of the fault 17.

Figure 3:
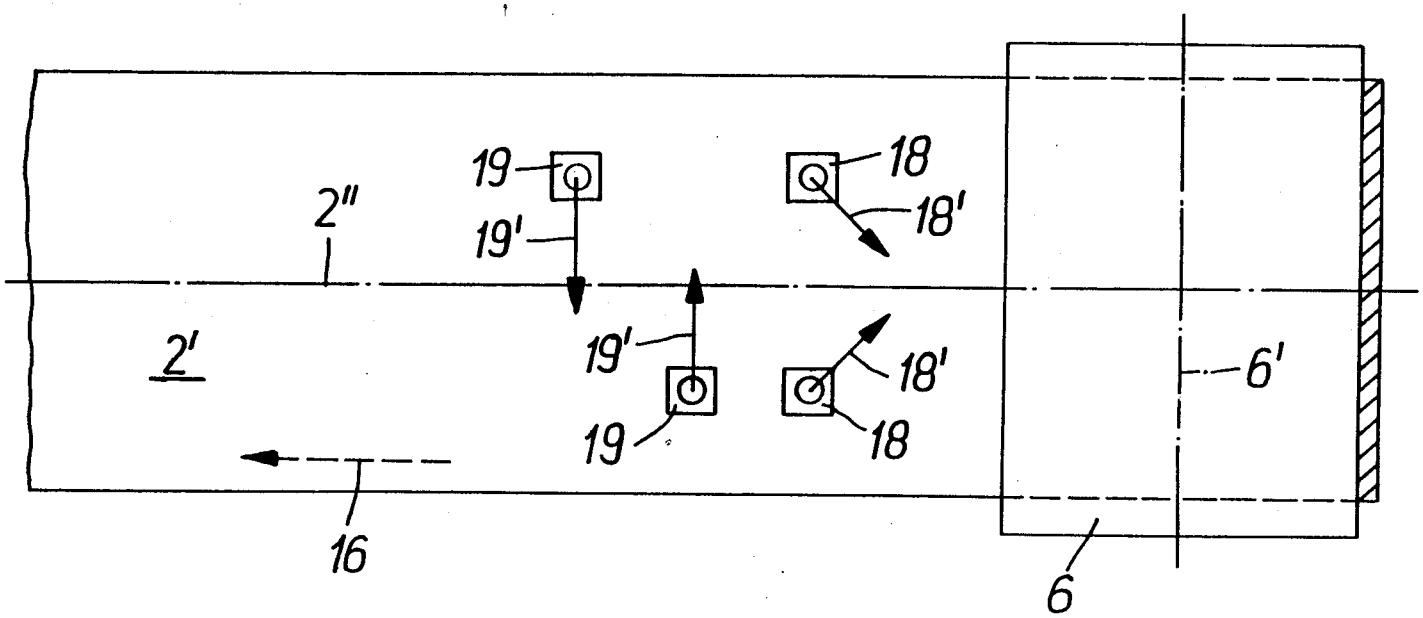
FIG. 3 is a partial horizontal sectional view, to a scale different from that of FIG. 1, of the lower casting belt shown in FIG. 1 and schematically showing an arrangement according to the invention of four cooperating testing units.

In the preferred arrangement of the testing apparatus according to the invention shown in FIG. 3 , four sonic transmitter-receiver units are utilized with two sonic units 18 being obliquely oriented with respect to the longitudinal axis 2'' of the casting belt 2' and two sonic units 19 being transversely oriented with respect to the longitudinal axis 2''. As shown, the two transversely oriented units 19 are disposed behind the obliquely oriented units 18 in the direction of rotation or movement of the belt 2' (Arrow 16), with the two obliquely orientied sonic units 18 being disposed in a straight line transversely to the longitudinal axis 2'' of casting belt 2'. The transversely oriented sonic units 19, on the other hand are offset with respect to one another along the longitudinal axis 2''. With respect to one another, the pair of obliquely oriented sonic units 18 and the pair of transversely oriented sonic units 19 emit sonic energy in respectively opposite directions 18' and 19'. Preferably, as shown the units 18 transmit sonic energy in a direction 18' which forms an angle of 45° with the longitudinal axis 2'', but this angle may be between about 30°–60° as desired.

The lateral position of testing units 18 and 19 is advisably selected such that the entire region of the casting belt over the width of the casting cavity (see FIG. 1) and which is particularly subject to danger is covered. In view of the preferred embodiment of the invention, this means that the two oblique sonic units 18 and the two transverse sonic units 19 are offset with respect to one another in the direction transverse to the longitudinal axis 2'' by one-half the width of casting cavity 4 of the continuous casting mold 1 and are disposed substantially symmetrically on either side of the center side of the center or axis 2'' of the casting belt 2'. A similar arrangement of two transverse units 19 and two oblique units 18 is provided for the other casting belt 2. Since, in the normal case, the width of the casting belts 2, 2' is greater by a multiple than the width of the associated casting cavity, it is not necessary to monitor from the side edges.

The advantage resulting from the use of two cooperating oblique sounding units 18 is that the hit accuracy in the detection of faults disposed at different locations is increased. However, if desired only one oblique unit 18 may be utilized in which case it is preferably positioned so that it lies on a straight line transverse to the axis 2'' with the first one of the transverse units 19.

Figure 4:
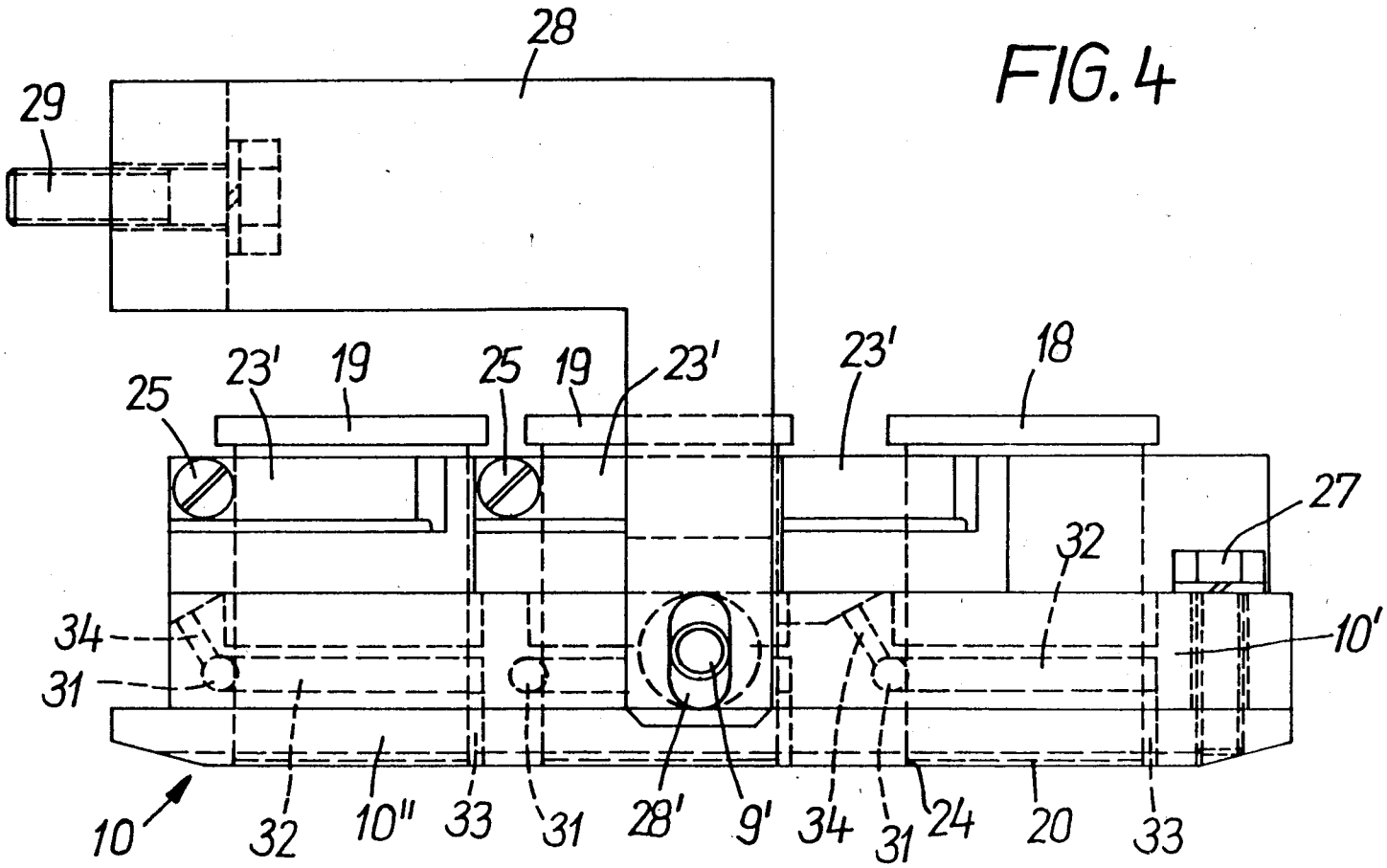
FIG. 4 is a schematic elevation of a skid on which four testing units are mounted.
Figure 5:
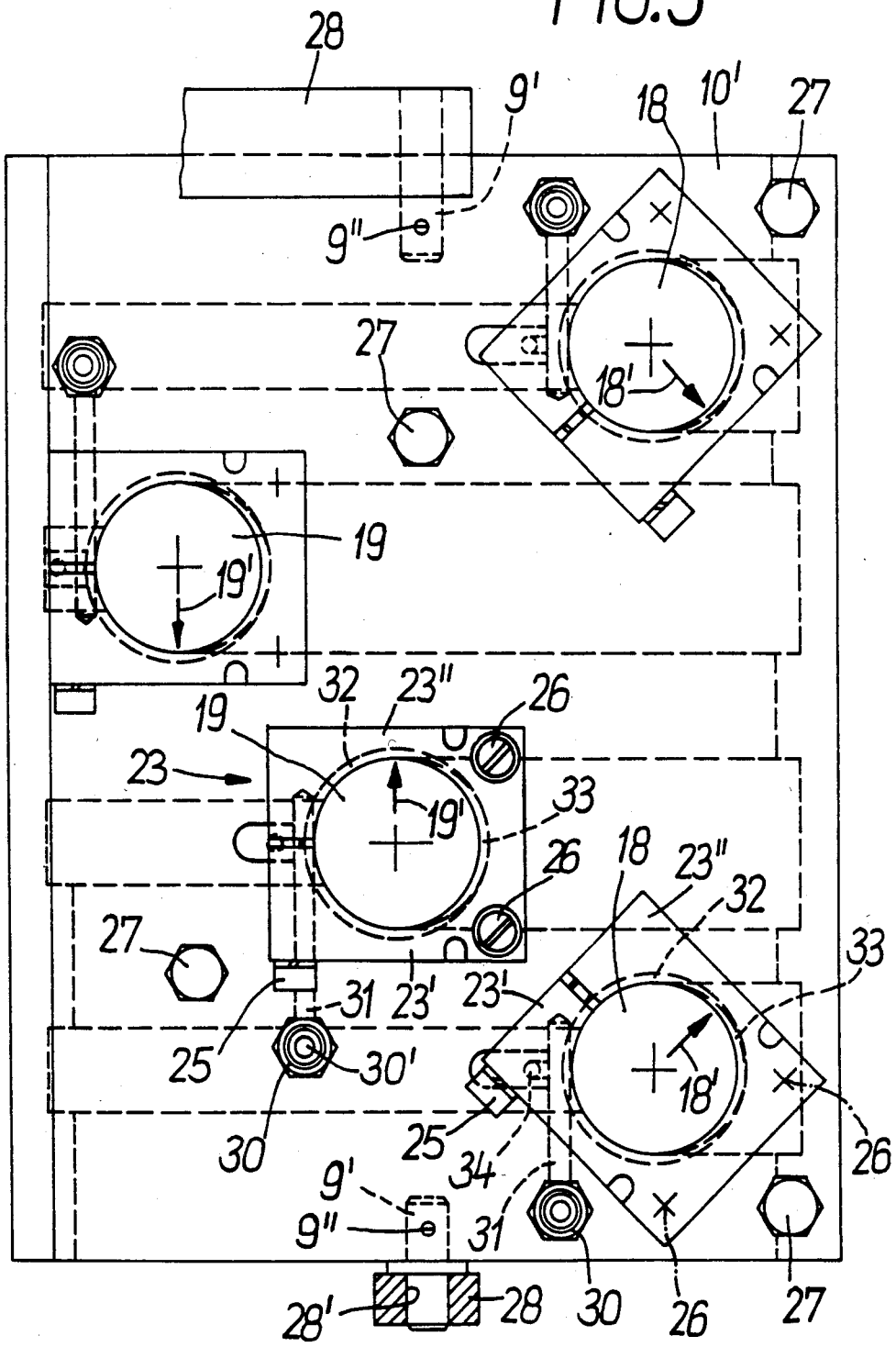
FIG. 5 is on a smaller scale than FIG. 4, a plan view of the skid with the testing units arranged as shown in FIG. 3.

In the embodiment of the present invention represented in FIGS. 4 and 5, the skid 10, shown by way of example for the lower casting belt $2'_1$, accommodates two oblique sounding units 18 and two transverse sounding units 19; these are arranged in the manner indicated in FIG. 3, i.e. the two oblique units 18 are disposed next to each other in a straight line, in front of the two transverse units 19, transversely to the longitudinal extent of the casting belt (not shown).

Each testing unit is held in the envisaged position in a vertical drilled hole 24 in the skid 10 by means of a clamping device 23 featuring two clamping jaws 23' and 23'' which can be brought together. The clamping effect of the clamp jaws 23' and 23'' can be steplessly adjusted by means of a screw 25 penetrating the clamping jaws. The clamping jaws themselves are each fastened by two countersunk screws 26 to an intermediate plate 10' which, via hexagonal-head bolts 27, also supports the skid plate 10'' facing the casting belt.

The intermediate plate 10', disposed transversely to the longitudinal extent of the casting belt, is equipped with two bolts 9' which are held by spring plungers 9'' and form the pivotal axis 9 already mentioned (c.f. FIG. 1).

The two bolts 9' each engage a vertical slot 28' in an angular console 28 which is bolted with hexagonal-head bolts 29 to the frame of the twin-belt continuous-casting mold (not shown). The slot 28' ensures that the skid 10 can perform both pivotal movements and adjustment movements vertically to its longitudinal extent.

To produce the water film required as coupling medium, the intermediate plate 10' is equipped in the region of each testing unit 18 or 19 with a pipe system which—starting from a connecting valve 30 with a vertical drilled hole 30' to accommodate a hosepipe—comprises the following: a straightline drilled feed hole 31 leading to an annular groove 32 enclosing the respective testing unit 18 or 19, beneath the annular groove 32 a semi-oval extension 33 which is aligned in the opposite direction to the movement of the casting belt and whose cross section forms a vertical outlet channel penetrating the skid plate 10'' (c.f. FIG. 4) and an oblique drilled hole 34 starting at the drilled feed hole 31 and ending at the upper side of the intermediate plate 10'.

Figure 6:
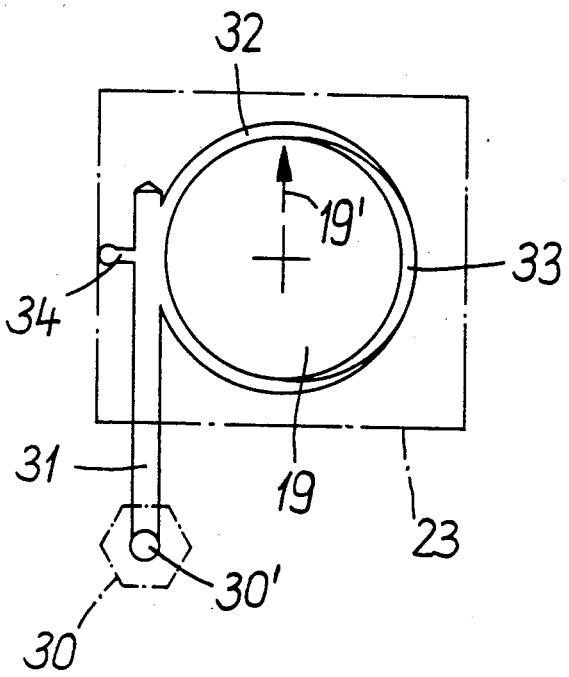
FIG. 6 is a schematic representation of the pipe system which feeds water to the skid in the region of a transverse sounding unit.

The water entering in the region of the connection valve 30 is thus conveyed (c.f. FIG. 6) via the drilled feed hole 31, the annular groove 32 and the semi-oval extension 33 in the region of the mounting drill hole 24 under the respective testing unit 18 or 19 and via the oblique drilled hole 34 to the intermediate plate 10' for cooling purposes. The water film formed under the testing units is given the designation 20 (c.f. FIG. 2).

It will be understood that the above description of the present invention is susceptible to various modifications, changes and adaptations, and the same are intended to be comprehended within the meaning and range of equivalents of the appended claims.

What is claimed is:

1. In a continuous metal caster of the type having mold walls formed by a pair of vertically opposed co-rotating endless casting belts and a pair of co-rotating lateral dam blocks; the improvement comprising testing means disposed adjacent said casting belts during operation of said caster for detecting damage to said casting belts, said testing means including a respective plurality of ultrasonic testing units disposed adjacent a surface of each said casting belt, with each said testing unit having an ultrasonic transmitter-receiver sonically coupled to the adjacent said casting belt; and means for mounting each said testing unit so that it is stationary with respect to the direction of movement of the adjacent said casting belt.

2. Apparatus as defined in claim 1, wherein said testing units are disposed in that region of the adjacent said casting belt which performs the return movement of the belt opposite to the casting direction.

3. Apparatus as defined in claim 2 wherein each said testing unit includes a skid portion which faces said surface of the adjacent said casting belt and supports the testing unit on said surface via a thin film of water.

4. Apparatus as defined in claim 3 further comprising spray apertures disposed in the region of said testing units for introducing water between each said skid and the associated adjacent said surface of said casting belt.

5. Apparatus as defined in claim 4 wherein said apertures are located in said skids.

6. Apparatus as defined in claim 3 wherein said mounting means includes means for supporting each said testing unit so that it is pivotal about a respective horizontal axis.

7. Apparatus as defined in claim 6 wherein said mounting means for at least some of said testing units includes spring means for exerting a force on the testing unit in the direction toward the surface of the adjacent said casting belt.

8. Apparatus as defined in claim 6 wherein said testing units for each said casting belt are mounted within the closed path defined by the associated said endless casting belt and are coupled to the surface of said associated said casting belt which forms an outer surface of the casting mold.

9. Apparatus as defined in claim 8 wherein said mounting means for said testing units associated with the upper of said casting belts includes spring means for exerting a force on said testing units in a direction toward the adjacent surface of the said upper casting belt.

10. Apparatus as defined in claim 1 wherein said respective plurality of ultrasonic testing units includes at least two of said testing units oriented to transmit and receive sonic energy in opposite directions transverse to the longitudinal center axis of the associated said casting belt and a third said testing unit oriented to transmit and receive sonic energy in a direction oblique to said longitudinal center axis of the associated said casting belt.

11. Apparatus as defined in claim 10 wherein said two of said testing units are offset with respect to one another in the longitudinal direction of said casting belt.

12. Apparatus as defined in claim 11 wherein said third of said testing units is disposed on a straight line parallel to said longitudinal axis with one of said two of said testing units.

13. Apparatus as defined in claim 11 wherein: each said respective plurality of testing units includes a fourth said testing unit oriented to transmit and receive sonic energy in a direction oblique to said longitudinal center axis of the adjacent said casting belt; said third and fourth testing units are arranged in approximately a straight line transverse to said longitudinal center axis; and said two of said testing units are disposed behind said third and said fourth testing units when seen in the direction of rotation of said casting belt.

14. Apparatus as defined in claim 13 wherein: said two of said testing units are disposed on either side of said longitudinal axis; said third and fourth of said testing units are disposed on either side of said longitudinal axis; and the transverse spacing between said two of said testing units and between said third and fourth of said testing units is one half of the width of the casting mold.

15. Apparatus as defined in claim 14 wherein said third and fourth of said testing units are disposed on respective straight lines parallel to said longitudinal axis with respective ones of said two of said testing units.

16. A method of continuously monitoring the casting belts of a continuous metal caster, which is of the type having co-rotating mold walls formed by a pair of vertically opposed endless casting belts and a pair of lateral dam blocks, for the detection of damage to the casting belts during operation of the caster comprising:

positioning a respective plurality of ultrasonic transmitter-receiver testing units adjacent each of the casting belts so that they are stationary with respect to the direction of movement of the adjacent casting belt, and sonically coupled to the surface of the associated casting belt;

transmitting ultrasonic energy from each of the testing units into the adjacent casting belt;

receiving reflected ultrasonic energy from the adjacent casting belt at each of said testing units; and detecting damage to a casting belt from any difference between the received signals at a testing unit resulting from reflection from a fault in the casting belt.

17. A method as defined in claim 16 wherein said plurality of testing units includes at least three testing units and said step of positioning includes disposing two of the testing units so that they are oriented to transmit and receive sonic energy in opposite directions transverse to the longitudinal center axis of the associated casting belt and the third testing unit so that it is oriented to transmit and receive sonic energy in a direction oblique to the longitudinal center axis of the associated casting belt.

18. A method as defined in claim 17 wherein said plurality of testing units includes a fourth testing unit and said step of positioning includes disposing the fourth testing unit so that it is oriented to transmit and receive sonic energy in a direction oblique to the longitudinal center axis of the adjacent said casting belt, so that the third and fourth testing units are arranged in approximately a straight line transverse to said longitudinal center axis, and so that the third and fourth testing units are disposed ahead of the two testing units when seen in the direction of rotation of the casting belt.

* * * * *

UNITED STATES PATENT AND TRADEMARK OFFICE

CERTIFICATE OF CORRECTION

PATENT NO. : 4,573,521

DATED : March 4, 1986

INVENTOR(S) : Gerd Artz et al

It is certified that error appears in the above-identified patent and that said Letters Patent is hereby corrected as shown below:

In the heading of the patent, under [73], the assignee's name should read: -- Fried. Krupp Gesellschaft mit beschränkter Haftung --.

Signed and Sealed this

*Tenth* Day of *June 1986*

[SEAL]

*Attest:*

*Attesting Officer*

DONALD J. QUIGG

*Commissioner of Patents and Trademarks*